US005360167A

United States Patent [19]

Grundy et al.

[11] Patent Number: 5,360,167

[45] Date of Patent: Nov. 1, 1994

[54] ADJUSTABLE RADIUS SPRINKLER NOZZLE

[75] Inventors: Michael J. Grundy, Phelan; Jeff B. McKenzie; Rebecca R. Reade, both of Riverside, all of Calif.

[73] Assignee: The Toro Company, Minneapolis, Minn.

[21] Appl. No.: 91,662

[22] Filed: Jul. 13, 1993

Related U.S. Application Data

[63] Continuation-in-part of Ser. No. 703,897, May 22, 1991, Pat. No. 5,226,602, which is a continuation-in-part of Ser. No. 406,795, Sep. 13, 1989, Pat. No. 5,031,840.

[51] Int. Cl.[5] ..... B05B 1/32

[52] U.S. Cl. ..... 239/460; 239/583; 251/90

[58] Field of Search ..... 251/297, 90; 137/383; 239/451, 460, 583

[56] References Cited

U.S. PATENT DOCUMENTS

| | | | |
|---|---|---|---|
| 1,659,843 | 2/1928 | Trottier | 251/90 X |
| 1,689,236 | 10/1928 | Fraser | 251/90 X |
| 1,875,857 | 9/1932 | Cruff et al. | 137/383 X |
| 2,348,776 | 5/1944 | Bentley | 239/460 |
| 3,244,376 | 4/1966 | Thompson | 239/460 X |
| 3,876,151 | 4/1975 | Katsa | 239/583 X |
| 4,506,702 | 3/1985 | Doup . | |
| 5,158,232 | 10/1988 | Tyler et al. . | |

*Primary Examiner*—Andres Kashnikow
*Assistant Examiner*—Kevin P. Weldon
*Attorney, Agent, or Firm*—James W. Miller

[57] ABSTRACT

An adjustable arc sprinkler nozzle comprises a nozzle body which has a plurality of radial channels for forming radial streams out of water flowing into the nozzle from a sprinkler body to which the nozzle is joined. A crown shaped deflector member includes a plurality of vertically extending fingers which operatively coact with the radial nozzle channels to restrict the amount of water flowing therethrough. A selectively operable adjusting member is cooperatively engaged with the deflecting member for moving the deflecting member vertically relative to the nozzle body to vary the position of the fingers relative to the channels to change the amount of water restriction imposed by the fingers on the water flowing through the channels, whereby the throw radius is selectively adjusted by vertical movement of the deflecting member. A selectively operable locking member, i.e. a locking cover or a two-position locking pin, is provided for preventing movement of the adjusting member to lock out any adjustment in the throw radius.

18 Claims, 7 Drawing Sheets

ADJUSTABLE RADIUS SPRINKLER NOZZLE

CROSS REFERENCE TO RELATED APPLICATION

This application is a continuation-in-part of my copending application Ser. No. 07/703,897, filed May 22, 1991, now U.S. Pat. No. 5,226,602, which is a continuation-in-part of application Ser. No. 07/406,795, filed Sep. 13, 1989, now U.S. Pat. No. 5,031,840.

TECHNICAL FIELD

This invention relates to a sprinkler nozzle for a water sprinkler which forms radially extending streams of water. More particularly, the present invention relates to a sprinkler nozzle in which the radius of throw of the streams of water can be quickly and easily adjusted without having to change nozzles. Preferably, the throw radius is adjusted while keeping the precipitation rate on the area being sprinkled relatively constant.

BACKGROUND OF THE INVENTION

In the irrigation industry today, many different types of water sprinklers are provided. In many cases, the nozzle is carried on a sprinkler having some mechanism for rotating the nozzle around in a circle. Some such rotary sprinklers also comprise "pop-up" sprinklers. In a "pop-up" sprinkler, the nozzle is carried on the upper end of a "riser" which is normally retracted into an outer sprinkler body buried in the ground.

One well known type of rotary, pop-up sprinkler is the Series 300, Stream Rotor sprinkler manufactured and sold by The Toro Company. The nozzle used in a Stream Rotor sprinkler is made of a lower nozzle piece fixed, as by sonic welding, to an upper nozzle piece. The nozzle includes a series of radially extending nozzle channels which end in a series of outlet ports spaced around the nozzle. Thus, the nozzle throws out a series of radial water streams which rotate around in a circle as the nozzle is rotated by the drive train, giving rise to the name "Stream Rotor".

The pattern of rotating water streams provided by a Stream Rotor nozzle is aesthetically pleasing to many people. In addition, the radius of throw for a given water pressure is increased by forming the water into distinct streams. However, prior to the present invention, it was not possible to easily and quickly adjust the throw radius of a Stream Rotor nozzle. This fact complicated the design and installation of irrigation systems.

For example, if an area is irrigated by multiple Stream Rotor sprinklers, each sprinkler will water a circular area determined by the maximum throw radius of the nozzle. The area of coverage of adjacent sprinklers should desirably overlap a small amount to properly water the area. However, overwatering will result if the sprinkler coverage overlaps too much. Thus, it is often necessary to decrease the throw radius of certain sprinklers to achieve the proper coverage and best results.

Prior to the present invention, for a given water pressure it was the practice to adjust the throw radius by changing nozzles on the sprinkler. Different nozzles were provided by the manufacturer with each nozzle being individually designed to throw water to a certain maximum radius while flowing a certain number of gallons per minute. An installer who needed to decrease the radius of throw of a certain sprinkler would simply choose a nozzle designed to throw to the necessary radius and install that nozzle on the sprinkler. This adjustment process might be required for quite a few sprinklers in an entire irrigation job.

Unfortunately, the need to have on hand an entire array of different nozzles to adjust throw radius complicates the installer's business. If an installer is out of stock on a particular nozzle, and that nozzle is required in a job, then the installer has to go and get one to complete the job, costing him or the customer time and money. Alternatively, the installer might be tempted to simply install the wrong nozzle on the sprinkler to save the aggravation of having to get the right nozzle. However, this would leave an irrigation system which is not operating as well as it should.

SUMMARY OF THE INVENTION

One aspect of this invention is to provide a simple and durable sprinkler nozzle whose radius of throw can be quickly and easily adjusted, and having means for selectively locking out the radius adjustment.

A nozzle according to this invention is one suited for connection to a sprinkler body. The nozzle comprises a nozzle body having at least one nozzle passageway for spraying water therefrom. A selectively operable radius adjustment means is carried on the nozzle body for varying the amount of water flowing through the nozzle passageway(s) to adjust the radius of throw of the nozzle. In addition, a selectively operable locking means is carried on the nozzle body for preventing the operation of the radius adjustment means to prevent any change in the radius of throw when the locking means is engaged.

BRIEF DESCRIPTION OF THE DRAWINGS

The present invention will be described hereafter in the Detailed Description, taken in conjunction with the following drawings, in which like reference numerals refer to like elements or parts throughout.

DETAILED DESCRIPTION

Figure 1:
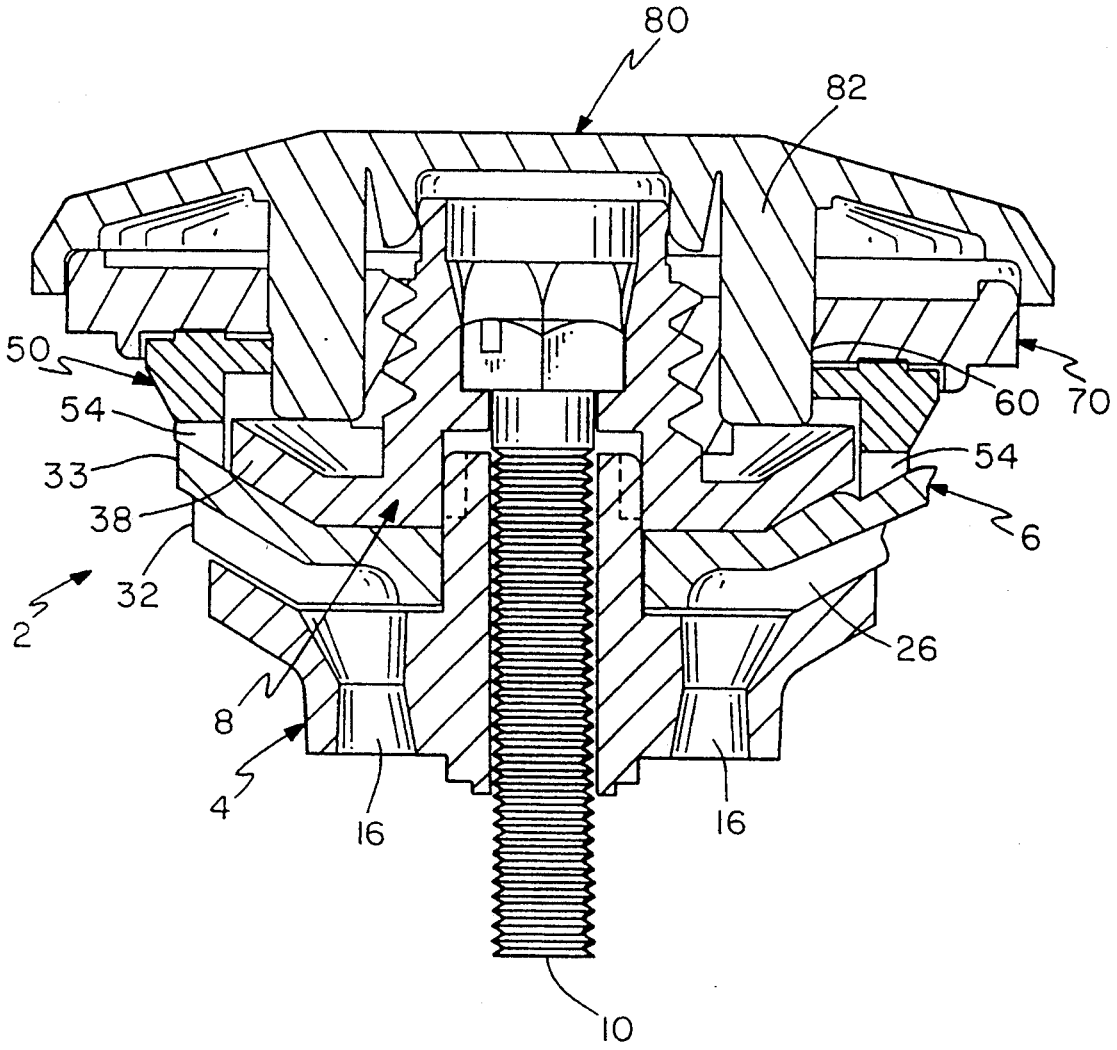
FIG. 1 is a cross-sectional side elevational view of a first embodiment of a sprinkler nozzle according to the present invention with the parts thereof shown in an assembled relationship, and illustrating on the left side of FIG. 1 the upper nozzle piece in its normal orientation for throwing water to a maximum radius and on the right side of FIG. 1 the upper nozzle piece in its compressed orientation for throwing water to a shorter radius.

Referring first to FIG. 1, a sprinkler nozzle according to the present invention is shown generally as 2. Nozzle 2 is designed as a Stream Rotor type nozzle, suited for use with the Series 300, Stream Rotor sprinklers manufactured and sold by The Toro Company, the assignee of the present invention. Such sprinklers are illustrated in U.S. Pat. No. 3,854,664, also assigned to The Toro Company, which is hereby incorporated by reference for teaching the details of such sprinklers. However, nozzle 2 is not limited for use with such sprinklers, but can instead be used on any sprinkler body when it is desired to spray relatively discreet radial streams from the nozzle.

Figure 2:
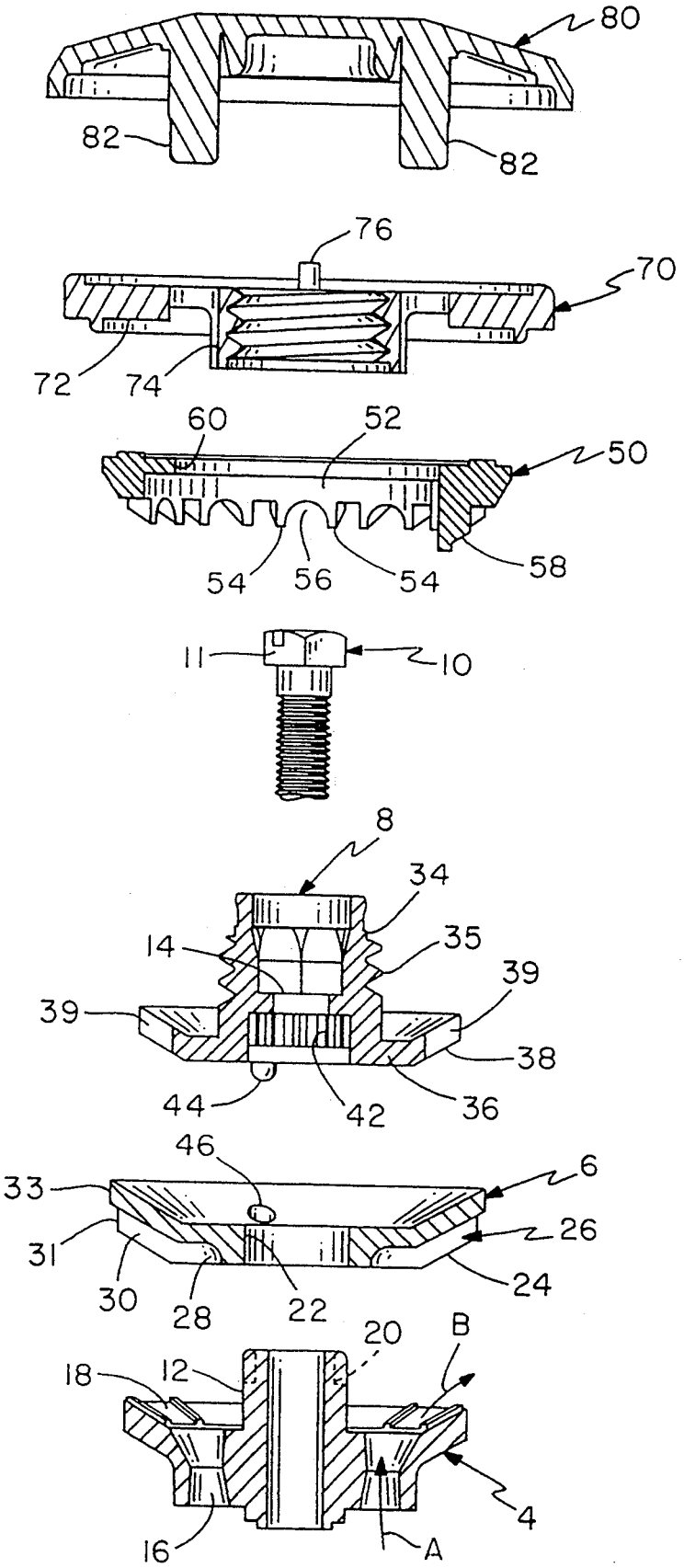
FIG. 2 is an exploded cross-sectional view of the nozzle shown in FIG. 1 with the parts thereof being separated for the purpose of clarity.
Figure 3:
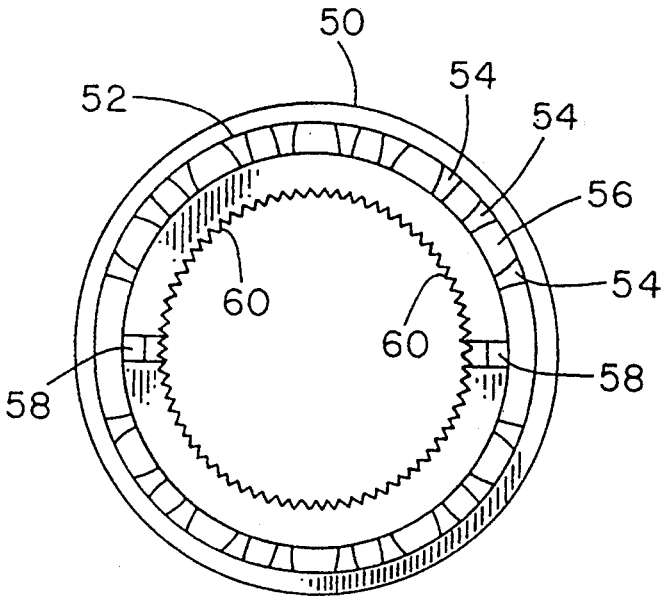
FIG. 3 is a bottom plan view of the deflector ring portion of the sprinkler nozzle shown in FIG. 1.

Nozzle 2 comprises a number of separate parts which may be assembled into a completed unit. FIG. 1 shows the parts in an assembled form, while FIG. 2 illustrates the parts in an exploded form. Reference should be had as needed to such Figures in conjunction with the following description.

Nozzle 2 comprises a lower nozzle piece 4, an upper nozzle piece 6, and means for clamping pieces 4 and 6 together to form a completed nozzle 2. The clamping means comprises a clamping member 8 and a fastening screw 10. Screw 10 may be threaded down into a central stem 12 of lower nozzle piece 4 until the head 11 of screw 10 is tightened against a bearing surface 14 in clamping member 8. When screw 10 is so tightened, upper nozzle piece 6 will be sandwiched between lower nozzle piece 4 and clamping member 8. Thus, screw 10 holds lower nozzle piece 4, upper nozzle piece 6 and clamping member 8 together.

In addition, screw 10 extends substantially below lower nozzle piece 4. This extended portion of screw 10 is threadedly received in the output shaft (not shown) of a gearbox (not shown) in the body of a typical Stream Rotor sprinkler (not shown). Thus, screw 10 also serves to secure nozzle 2 to the sprinkler body in addition to holding the various pieces 4, 6 and 8 of nozzle 2 together. However, other methods of securing nozzle 2 to a sprinkler body could be used. In this event, screw 10 would not have to extend down past lower nozzle piece 4.

As is typical in a Stream Rotor type nozzle, lower nozzle piece 4 includes a plurality of inlet ports 16 spaced circumferentially in a ring around stem 12, two of the ports 16 being shown in FIGS. 1 and 2. Pressurized water passes upwardly through ports 16, as indicated by the arrows A, from the interior of the sprinkler body to which nozzle 2 is attached. In addition, lower nozzle piece 4 includes an upwardly inclined, annular water dispersing surface 18 surrounding ports 16 and leading radially outwardly therefrom. The water will flow radially outwardly along surface 18, as indicated by the arrows B, when confined by the presence of upper nozzle piece 6, as described hereafter.

Upper nozzle piece 6 is generally circular and has a shape so that it can be mated against lower nozzle portion 4. Upper nozzle piece 6 includes a central opening 22 through which stem 12 of lower nozzle piece 4 is inserted. In addition, the lower surface 24 of nozzle piece 6 is formed with a plurality of radially extending channels 26, corresponding in number to the number of ports 16. Each channel 26 has a radially inner end 28 located above one of the ports 16, an upwardly inclined portion 30 along the upwardly inclined radially outer portion of nozzle piece 6, and a radially outer end which defines one outlet port 31 of nozzle 2. When upper nozzle piece 6 is in engagement with lower nozzle piece 4, channels 26 confine and form the water on surface 18 into a plurality of discreet, radial streams.

One important aspect of this invention is that upper nozzle piece 6 is formed of a relatively flexible and compressible material, such as a soft rubber material, while all the other components of nozzle 2, including lower nozzle piece 4, are molded from relatively hard plastic materials of the type often used in sprinklers. The use of such a soft, compressible material in upper nozzle piece 6 allows the channels 26 to be bent and compressed as described later to adjust the radius of throw of the nozzle streams. In addition, as shown in FIG. 1, upper nozzle piece 6 has a slightly larger diameter than lower nozzle piece 4 to form a small portion 32 that overhangs or extends beyond lower nozzle piece 4. The use of this overhang portion 32 is also preferred as described hereafter.

Clamping member 8 includes a generally cylindrical body 34 with an annular flange 36 at its bottom end. Flange 36 includes an upwardly inclined portion 38 which again mimics the shape of the nozzle pieces 6 and 8 so as to mate firmly thereagainst. See FIG. 1. Clamping member 8 has a longitudinal passageway 40 through which screw 10 extends down into lower nozzle piece 4. Bearing surface 14 is located in the middle of passageway 14 and an annular array of grooves or flutes 42 is placed adjacent the lower end of passageway 40. Flutes 42 form a splined connection with a similar array of grooves of flutes 20 on the top of stem 12 of lower nozzle piece 4.

In assembling the components of nozzle 2 described so far, upper nozzle piece 6 can be pushed down over lower nozzle piece 4 until stem 12 passes upwardly through opening 22 and the mating surfaces of the two pieces are engaged against one another. Then, stem 12 is inserted into passageway 40 of clamping member 8 and clamping member 8 is pushed down over the stem until it firmly engages against the top of upper nozzle piece 6. Clamping member 8 includes two downwardly projecting pins 44 which are received in shallow holes 46 in the top of upper nozzle piece 6. This pin and hole connection between upper nozzle piece 6 and clamping member 8, in conjunction with the splined connection between clamping member 8 and lower nozzle piece 4, aligns the radial channels 26 in upper nozzle piece 6 with the ports 16 in lower nozzle piece 4. Then, screw 10 is inserted into passageway 40 and tightened in lower nozzle piece 4 until it firmly engages bearing surface 14.

As described thus far, nozzle 2 would be operative to dispense water in radially extending streams through channels 26 in upper nozzle piece 6. The parts are configured so that clamping member 8 will Firmly hold the upper nozzle piece 6 against the lower nozzle piece 4 when screw 10 is fully tightened, but will not significantly deform channels 26. Thus, channels 26 normally have an undeformed orientation, shown in FIG. 4, in which the flow area of the channel is unobstructed. Further, in this orientation, channel 26 has a trajectory angle which is the same as that formed by the inclined portion 30 of the upper nozzle piece 6. Thus, as shown on the left side of FIG. 1, nozzle 2 will be throwing to its maximum radius in this channel configuration.

However, the present invention is specifically directed to a nozzle 2 which can be selectively manipulated to throw to shorter radii. Accordingly, nozzle 2 also includes deflecting means for compressing upper nozzle piece 6 against lower nozzle piece 4 to deform or compress channels 26. The deflecting means comprises an annular deflecting ring 50 and a selectively rotatable adjusting member 70.

Figure 4:
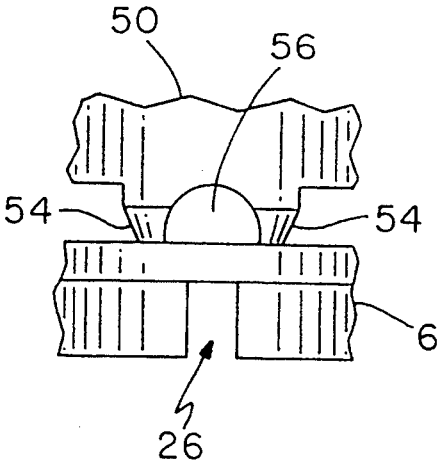
FIG. 4 is an enlarged side elevational view of one of the channels in the upper nozzle piece with the deflector ring not having compressed the channel from its normal orientation, corresponding to the maximum throw radius situation shown on the left side of FIG. 1.
Figure 5:
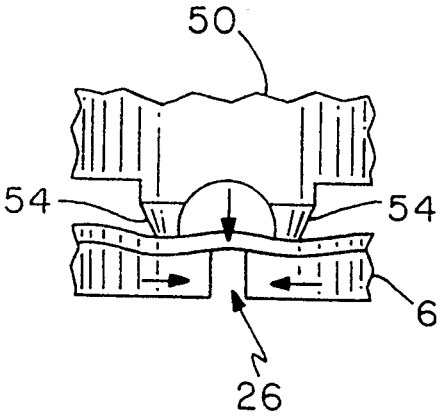
FIG. 5 is an enlarged side elevational view similar to that shown in FIG. 4, but illustrating the deflector ring as having compressed the channel from its normal orientation into a compressed orientation, corresponding to the shorter throw radius situation shown on the right side of FIG. 1.

Deflecting ring 50 has a downwardly extending rim 52. Rim 52 includes a plurality of pairs of spaced, downwardly extending fingers 54 separated by a semi-circular arch or recess 56. One such pair of fingers 54 is shown in FIGS. 4 and 5. In addition, rim 52 has a diameter large enough to allow deflecting ring 50 to be dropped down around clamping member 8. In this position, fingers 54 will extend down past the peripheral edge of flange 36 of clamping member 8 to bear against the top surface of upper nozzle piece 6. See FIG. 1.

In addition, deflecting ring 50 includes two downwardly extending alignment tabs 58 spaced radially inwardly from rim 52. Tabs 58 are received in two slots 39 in the inclined portion 38 of flange 36 of clamping member 8. The tab and slot connection aligns deflecting ring 50 with clamping member 8, and hence with upper nozzle piece 6, so that the fingers 54 in each pair will push down on upper nozzle piece 6 on either side of channel 26, as shown in FIGS. 4 and 5. In addition, the inner diameter of deflecting ring 50 contains serrations 60 for a purpose to be described hereafter.

Adjusting member 70 includes a substantially flat horizontal bearing surface 72 which bears against the top of deflecting ring 50. In addition, adjusting member 70 includes a hollow, central stem 74 which is interiorly threaded to engage external screw threads 35 provided on the exterior of clamping member 8. This threaded connection allows adjusting member 70 to be vertically moved relative to clamping member 8. Downward movement of adjusting member 70 also forces deflecting ring 50 downwardly to compress upper nozzle piece 6 against lower nozzle piece 4.

Preferably, the initial position of adjusting member 70 is one in which deflecting ring 50 engages, but does not compress, upper nozzle piece 6. This position, as shown in FIG. 4, allows nozzle 2 to throw water to its maximum radius. Then, if it is desired to shorten the throw radius, the operator or installer need only rotate adjusting member 70 downwardly on clamping member 8. This moves deflecting ring 50 downwardly to compress upper nozzle piece 6. Preferably, the top of adjusting member 70 is provided with two opposed ridges or tabs 76 to allow the installer to more easily grip adjusting member 70 to rotate it.

Two things happen when deflecting ring 50 compresses upper nozzle piece 6. First, the flow area of channel 26 is decreased or "pinched off" as shown in FIG. 5 in a uniform fashion, thereby allowing less water to flow through the channel. This decrease in the water flow will cause the radius of throw to shorten. In addition, since deflecting fingers 54 of ring 50 act on overhang portion 32 of upper nozzle piece 6, their downward movement also bends the overhang portion down over the lower nozzle piece 4, as shown on the right side of FIG. 1. This simultaneously lowers the trajectory angle of the water streams being thrown from channels 26.

Thus, nozzle 2 effectively decreases the throw radius for two reasons. First, because the amount of water flowing through the channels is decreased and, secondly, because the trajectory angle is simultaneously lowered. While throw radius could be decreased using either of these actions separately, the combination of the two actions is preferred. Applicants have discovered that in using both actions the radius can be decreased while keeping the precipitation rate relatively constant. In other words, as the trajectory angle lowers to decrease throw radius, the volume of water passing through the sprinkler lowers in concert with it, so that approximately the same amount of water is applied per unit area per unit time regardless of the radius chosen.

Accordingly, nozzle 2 according to this invention can be used to quickly and easily adjust the throw radius of a particular sprinkler without having to change nozzles. Now, all the installer need do to shorten the throw radius is to reach down and rotate adjusting member 70 downwardly until the radius has been sufficiently shortened. He no longer has to remove one nozzle to insert another. Thus, the installer only has to stock the single adjustable nozzle 2, and need not carry various differently sized nozzles as before. In addition, nozzle 2 can shorten its radius without an increase in the precipitation rate due to the simultaneous volumetric flow restrictions imposed by the pinching off of channels 26.

As illustrated in FIGS. 1 and 2, upper nozzle piece 6 is provided with an upper peripheral rim or shoulder 33 that extends out beyond channels 26. This rim serves as a support surface for various small fingers or obstructions (not shown) which extend down and partially obscure the outlet ends 31 of some, but not all, of the channels 26. These obstructions can have different shapes and lengths. Preferably, they could comprise small, semi-circular bumps molded onto the bottom of rim 33 to lie in front of channels 26.

Such obstructions as described above break up the streams of water exiting from certain channels 26 so that such streams cover the radially innermost portions of the circle being irrigated. Since most of the channels are unobstructed, the water streams exiting those channels will be projected to the radially outermost portions of the circle. Thus, obstructing at least some of the channels 26 will cause the entire pattern to be uniformly watered. However, the presence of rim or shoulder 33 is not important to the throw shortening feature of nozzle 2 and could be dispensed with if so desired.

In addition, the alignment tabs 58 on deflecting ring 50, after passing through slots 39 in clamping member 8, are aligned to be on top of two of the radial channels 26 in upper nozzle piece 6. Applicants have discovered from trial and error that it is sometimes necessary to restrict flow through at least a few of the channels 26 by more than the amount of compression provided by fingers 54 to help hold the precipitation rate constant as the throw radius comes down. This additional flow restriction is provided by making tabs 58 sufficiently long to normally compress two of the channels 26 even when the deflecting ring 50 is not otherwise compressing upper nozzle piece 6. The exact length required for tabs 58 to accomplish this "fine tuning" of the flow will vary depending on the desired precipitation rate for which nozzle 2 is designed.

While tabs 58 could overlie any two channels, it is preferred if they overlie those two channels which have the largest obstructions on rim 33, i.e. those two channels which are throwing to the inner portions of the pattern. Applicants have found that when the radius of nozzle 2 is shortened, and the trajectory angle of all the streams is lowered, the obstructed streams used to water the inner portions of the pattern can impact the ground with considerable force around the sprinkler, even to the extent of digging up the ground a bit. Thus, if additional volumetric flow restriction is required by adjusting the length of tabs 58, one might as well compress the channels throwing the most obstructed streams. This has the additional benefit of lessening the force with which the streams exit from such channels, thereby tending not to dig up the ground immediately adjacent the sprinkler even when nozzle 2 has been adjusted to throw short radii.

Another auxiliary feature of nozzle 2 is provided by the last component to be described, i.e. the locking cap or cover 80. Normally, if one were to look down on the top of nozzle 2, one would see adjusting member 70 along with printed directions on ring 70 for rotating it to adjust the throw radius of nozzle 2. This would serve as a temptation to vandals to reach down and rotate ring 70, thereby destroying the setting provided by the installer and requiring someone to reset it. In addition, it would also be desirable to have some means of locking adjusting member 70 in place to prevent accidental movement of ring 70.

Cover 80 provides both functions. It comprises a circular cap sufficiently large in diameter to cover adjusting member 70. This hides adjusting member 70 from casual view. Thus, cover 80 provides some vandal protection as it is not immediately apparent that nozzle 2 has such a thing as a rotatable adjusting member 70.

In addition, cover 80 is provided with two downwardly extending locking lugs 82. These lugs 82 pass downwardly through two holes provide in adjusting member 70 until they engage the serrations 60 on the inner diameter of deflecting ring 50. This locks or retains adjusting member 70 in place. However, cover 80 has a press fit on adjusting member 70 so that it can be easily popped off when it is desired to intentionally rotate member 70 to adjust the throw radius. Cover 80 can then be pressed back into place.

Figure 6:
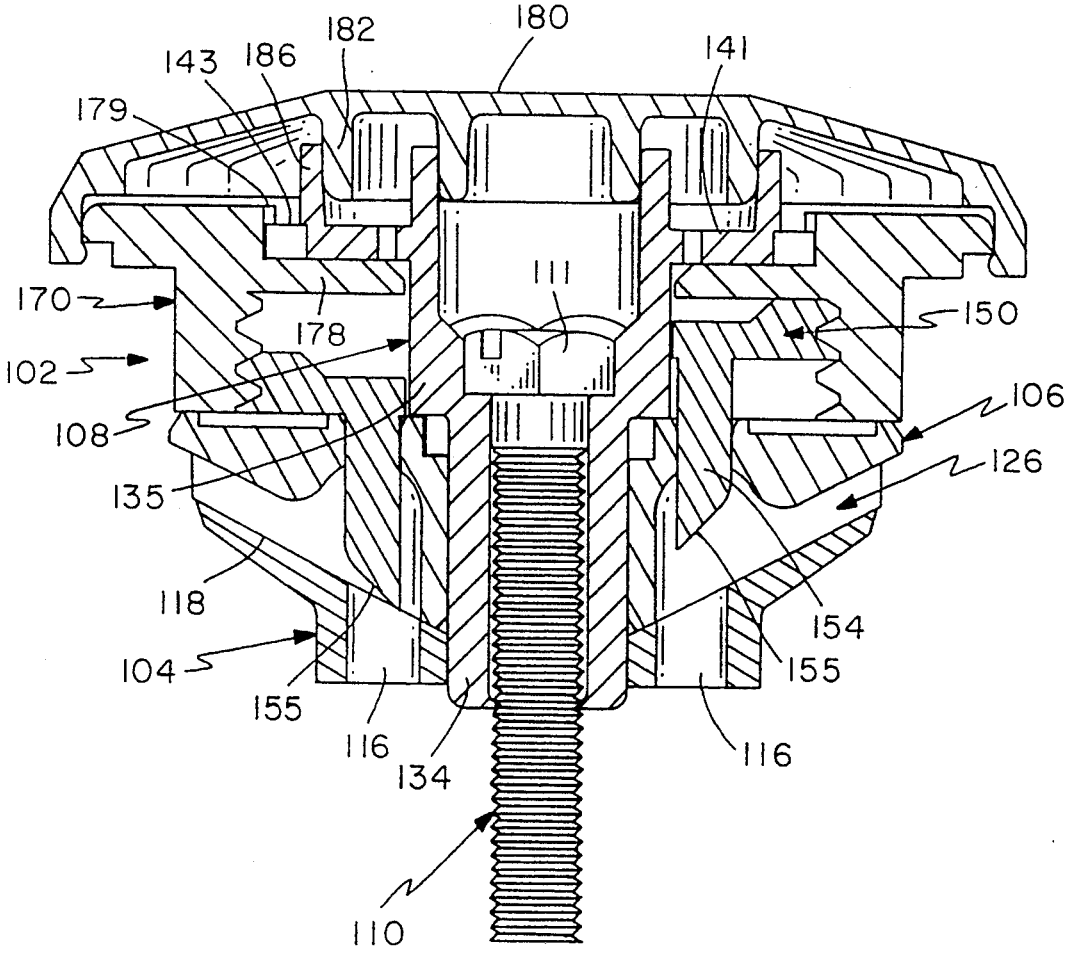
FIG. 6 is a cross-sectional side elevational view of a second embodiment of a sprinkler nozzle according to the present invention with the parts thereof shown in an assembled relationship, and illustrating on the right side of FIG. 6 the orientation of parts for throwing water to a maximum radius and on the left side of FIG. 6 the orientation of parts for throwing water to a shorter and minimum radius.
Figure 7:
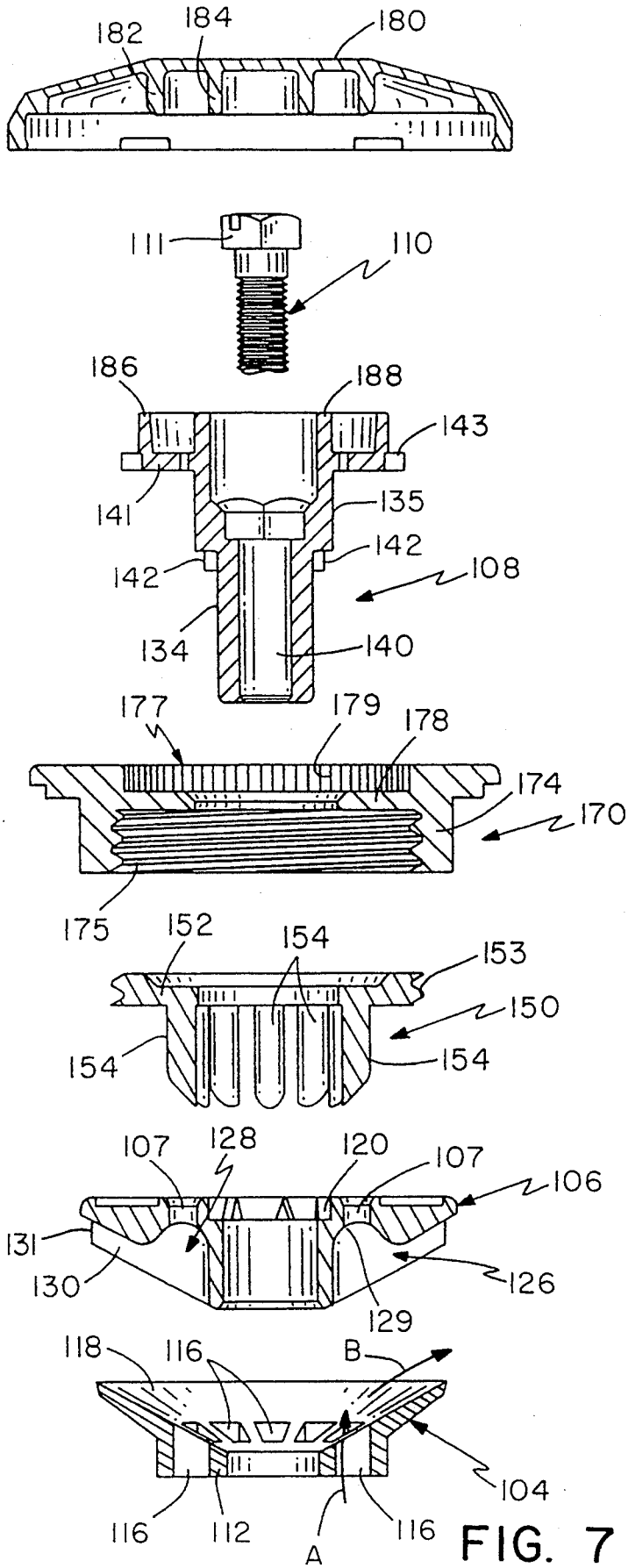
FIG. 7 is an exploded cross-sectional view of the nozzle shown in FIG. 6 with the parts thereof being separated for the purpose of clarity.
Figure 8:
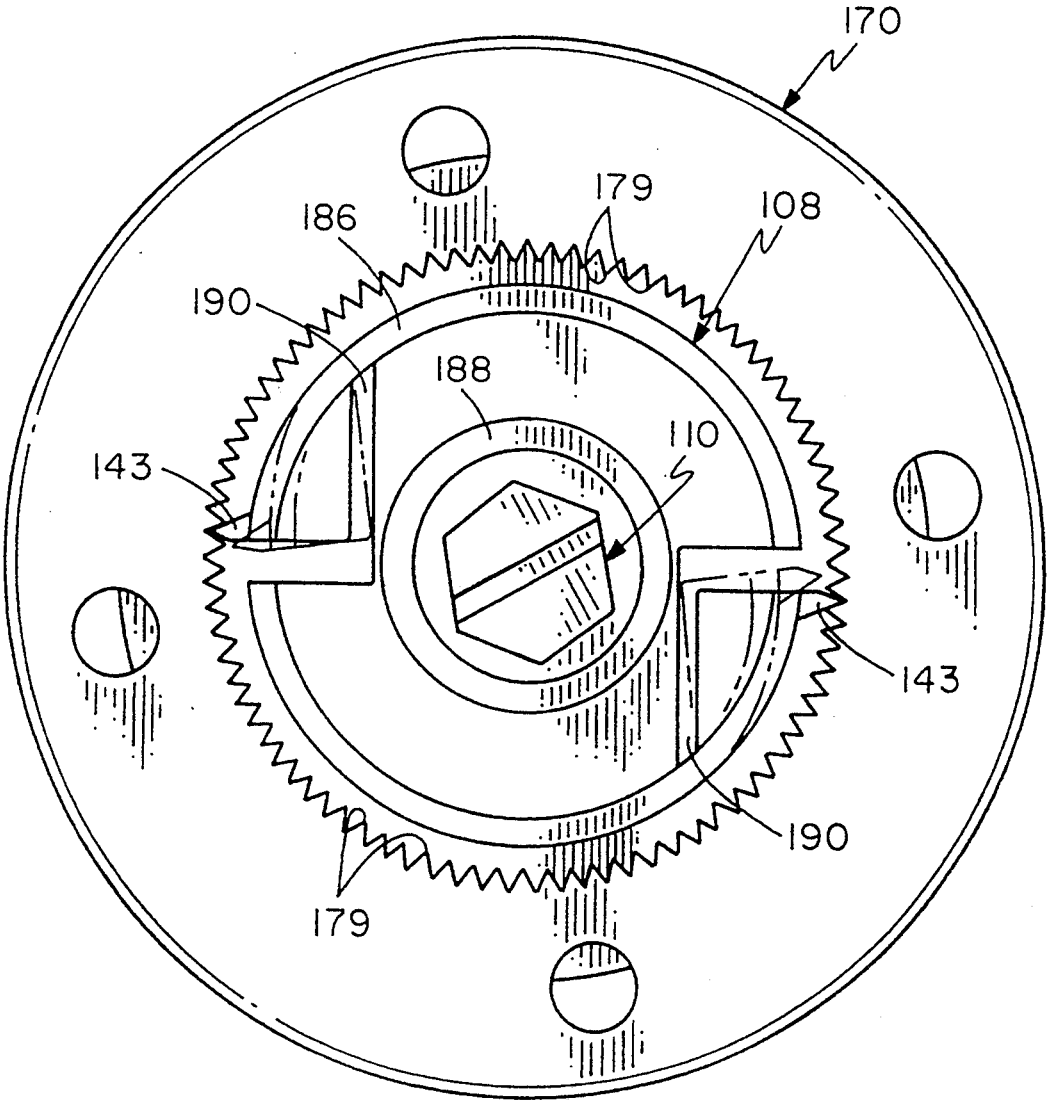
FIG. 8 is a top plan view of the sprinkler nozzle shown in FIG. 6 with the cover thereof being removed to illustrate the detent means for holding the adjusting member in a rotatively adjusted position.

Referring now to FIGS. 6–8, a second embodiment of an adjustable radius nozzle according to the present invention is illustrated generally as 102. The components of nozzle 102 which have counterparts in nozzle 2 will be referred to using the same reference numerals as used for the components in nozzle 2 with a 100 prefix being added to the reference numerals applied to the components of nozzle 102. Thus, nozzle 102 includes a lower nozzle piece 104 which is the counterpart to lower nozzle piece 4 of nozzle 2.

The components of nozzle 102 will not be specifically described to the extent they are identical to their counterparts in nozzle 2. Reference may be had to the description regarding the components of nozzle 2 for an understanding of the corresponding components in nozzle 102. However, the differences between the components of nozzle 102 and their counterparts in nozzle 2 will be described insofar as is necessary to an understanding of the structure and operation of nozzle 102.

In nozzle 102, upper nozzle piece 106 is no longer formed of a relatively flexible and compressible material as was true of upper nozzle piece 6 in nozzle 2. Instead, upper nozzle piece 106 is molded from the same relatively hard plastic materials as used for lower nozzle piece 104 and all the other major components of nozzle 102. Nozzle pieces 104 and 106 are now integrally joined together by sonic welding or any other suitable attachment method to form a relatively rigid nozzle body having a plurality of radially extending channels 126. To this extent, nozzle 102 is generally identical to the prior art nozzles used in conjunction with the Series 300 Stream Rotor sprinklers as described in the Background of the Invention section of the present application.

A clamping member 108 is still provided in nozzle 102, but it is shaped differently than clamping member 8 to serve a somewhat different purpose. Clamping member 108 is not needed to clamp the upper and lower nozzle pieces together as these two pieces 104 and 106 in nozzle 102 are rigidly secured together as described immediately above. Instead, clamping member 108 now includes an upper horizontal flange 141 which retains in place a rotatable adjusting means used to adjust the radius of throw of nozzle 102, as will be described in more detail hereafter. Flange 141 is located at the top of an enlarged head portion 135 of clamping member 108.

Clamping member 108 also includes a cylindrical body 134 which extends downwardly from head portion 135 to pass through the joined lower and upper nozzle pieces 104 and 106 when head portion 135 abuts against the top of upper nozzle piece 106. Screw 110 extends downwardly through passageway 140 in body 134 until head 111 of screw 110 engages against the bearing surface 114 of clamping member 108. As was true of nozzle 2, screw 110 is long enough to extend beneath lower nozzle piece 104 for the purpose of securing nozzle 102 to the sprinkler body, e.g. to the output shaft of a gearbox, when screw 110 is tightened.

Nozzle 102 includes selectively operable adjusting means for decreasing the radius of throw of the water streams passing through nozzle channels 126. In this regard, nozzle 102 is directed to the same problem as nozzle 2, i.e. providing a single nozzle whose radius of throw can be easily varied. This adjusting means comprises an annular deflecting ring 150 and a selectively rotatable adjusting member 170.

In the case of nozzle 102, deflecting ring 150 has a plurality of circumferentially spaced fingers 154 which project downwardly from an annular rim 152. Unlike nozzle 2 in which a pair of fingers 54 pressed down on the compressible upper nozzle piece 6 adjacent each side of a radial channel 26, only a single finger 154 is provided for each channel 126 in nozzle 102 with such finger 154 actually entering into that channel 126. Thus, the number of fingers 154 on deflecting ring 150 is equal to or less than the number of nozzle channels 126 existing in nozzle 102.

With respect to the number of fingers 154 used on deflecting ring 150, it would be possible to have exactly the same number of fingers as the number of channels 126 with one finger entering into each channel. However, it is customary for nozzles of this type to use a few external obstructions (not shown) on the upper nozzle piece to obstruct the water flowing out of a few of the channels to break the water steam up and allow it to water the radially inner portions of the pattern. The use of such obstructions in these nozzles is well known and was also previously described above with respect to upper nozzle piece 6 of nozzle 2. With such a nozzle, it would be best not to use flow obstructing fingers 154 in those channels 126 having the largest external flow obstructions located outside the outlet end of the channel, thus allowing the inner portions of the pattern to continue to be properly watered even as the radius of throw comes down. Thus, it is preferable that the number of fingers 154 be somewhat less, i.e. 1 or 2 less, than the number of channels 126 when certain of the nozzle channels 126 have exterior flow obstructions of the type just described.

Upper nozzle piece 106 has a circumferentially spaced array of holes 107 for allowing fingers 154 to project downwardly into radial channels 126. Fingers 154 enter channels 126 adjacent their radial inner ends 128 as clearly shown in FIG. 6. Each channel inner end 128 includes an enlarged upwardly extending water receiving pocket 129 (see FIG. 7), such pockets being present in the prior art Stream Rotor nozzles mentioned above. In addition, the outer diameter of rim 152 of ring 150 is exteriorly threaded as shown at 153 to be threadedly connected to adjusting member 170.

Adjusting member 170 comprises a cylindrical shell 174 which rests or bears against the top surface of upper nozzle piece 106. The inner diameter of shell 174 is threaded at 175 to mate with the threads 153 on deflecting ring 150. In addition, adjusting member 174 has a recess 177 in its upper end which recess is bounded on its lower side by a central annular flange 178. Recess 177 is deep enough to receive flange 141 on clamping member 108 with flange 141 on clamping member 108 overlying flange 178 on adjusting member 170.

When nozzle 102 is secured to the sprinkler body and screw 110 is tightened as far as it will go, adjusting member 170 will be retained by top flange 141 of clamping member 108. However, the parts are dimensioned so that any force imposed on adjusting member 170 is not so strong as to prevent adjusting member 170 from being easily turned by hand. Thus, the user can grip the outer diameter of adjusting member 170 and rotate it for the purpose of varying the throw radius. Detent tabs 143 extend radially outwardly from flange 141 and cooperate with inwardly extending radial splines 179 on adjusting member 170 to help hold adjusting member 170 in a rotatively adjusted position.

As noted earlier, fingers 154 on deflecting ring 150 pass downwardly into the inner ends 128 of nozzle channels 126 and, specifically, are aligned with and point towards the upwardly directed inlet ports 116 which supply water to channels 126. The lower edge of each finger 154 is formed by an upwardly inclined face 155. It is preferable that such face 155 be inclined more steeply than the angle of inclination of the water dispersing surface 118 on lower nozzle piece 104. The purpose for this will be discussed later.

When nozzle 102 is assembled as shown in FIG. 6, the vertical position of deflecting ring 150 can be selectively varied simply by rotating adjusting member 170. Deflecting ring 150 is shown on the right side of FIG. 6 in its uppermost position. In this position, fingers 154 have been raised up until their lower faces 155 are effectively located out of the water flow path, i.e. the lower faces 155 are at or above the plane of the upper inclined surface of radial channel 126. In this position, fingers 154 have little or no effect on the throw radius and the radius will be at its maximum for a given water pressure.

However, if the user wishes to decrease the throw radius, then adjusting member 170 can be manually rotated by hand in a direction to move deflecting ring 150 downwardly. Ring 150 is movable vertically by virtue of its threaded engagement with adjusting member 170. As fingers 154 move downwardly from their uppermost position shown on the right in FIG. 6, they will gradually obstruct or occlude the cross-sectional flow area of channels 126. This in turn reduces the volume of water flowing through the channels thus decreasing the throw radius.

The actual amount the throw radius is decreased is a function of how far down fingers 154 are moved. The lower the fingers are moved, the greater the decrease in the throw radius. In addition, since all the fingers 154 are identically shaped and positioned, the throw radius of all the water streams exiting from all the channels 126 having fingers 154 will be affected the same way, i.e. their throw radius will shrink or expand simultaneously by the same amount.

Fingers 154 have a lowermost position shown on the left side of FIG. 6 which position is reached when deflecting ring 150 arrives at the lowermost end of its travel on adjusting member 170. In this position, the lower faces 155 of fingers 154 are now located at or slightly above the intersection of the water inlet ports 116 and water dispersing surface 118, i.e. fingers 154 have not entered or the tips of fingers 154 have just begun to enter inlet ports 116. Because faces 155 are inclined and the cross-sectional area of fingers 154 is somewhat smaller than the cross-sectional area of inlet ports 116, water flow is not totally cut off to channels 126 even in the lowermost position of fingers 154, thus letting nozzle 102 flow to a short minimum radius.

As nozzle 102 was developed, the face 155 of fingers 154 was originally designed to have the same angle of inclination as the water dispersing surface 118. In testing this design, Applicants observed that the throw radius would not continue to decrease when fingers 154 approached their lowermost positions, but would, in fact, increase. Thus, this nozzle would not provide a decreasing throw radius over relatively short radii. When faces 155 were shaped to have a different angle of inclination from that of surface 118, this anomaly disappeared and the throw radius of nozzle 102 would continue to come down over the entire range of motion of deflecting ring 150. Thus, the disclosed different angle of inclination of lower faces 155 is preferred.

It is not absolutely certain why this change in the angle of inclination of lower face 155 was effective in solving the above noted problem. One hypothesis is that the lower face 155 when allowed to closely approach the inlet port 116 as it moves down "pinches off" port 116 much like holding one's thumb down over the end of a hose. This pinching off causes the flow velocity to increase which counteracts the decrease in throw radius being achieved by reducing the volume of water passing through channel 126. By changing the angle of lower face 155 to something different than that of surface 118, it is believed that the water flow is deflected into engagement with the various walls of channel 126, including into pocket 129, thus creating turbulence which slows the water flow and dissipates the velocity increase caused by the pinching off effect.

While the differently angled face 155 of fingers 154 is useful in getting a throw radius decrease over small radii, it would not appear to be as important if the fingers 154 in their lowermost position were to have the lower faces 155 spaced somewhat further above inlet ports 116 than is shown on the right side of FIG. 6. In this latter case, the pinching off effect should be largely absent, and a decrease in radius should be observed over the entire range of travel of fingers 154. The disadvantage of this approach is that such a nozzle could not throw to as small a radius as that of nozzle 102 as depicted in the drawings.

Nozzle 102 also includes a cover 180 having two, downwardly extending annular rings 182 and 184 that cooperate with and are press fit over two, upwardly extending annular rings 186 and 188 on clamping member 108. The outer annular ring 186 on clamping member 108 is split into two semi-cylindrical halves with the detent tabs 143 being located at one end of each ring half. Clamping member 108 further includes two clearance slots 190 in the top flange 141 thereof. One clearance slot 190 is located immediately in back of each tab 143. When adjusting member 170 is rotated relative to clamping member 108, detent tabs 143 are sequentially cammed back by splines 179, thus causing the end of each ring half to be flexed back into the clearance slot 190, to allow the rotary movement of member 170. The phantom line positions in FIG. 8 illustrate the flexed orientation of the ends of the ring halves caused by rotary movement of adjusting member 170.

When cover 180 is in place, ring 182 carried thereon will tightly engage against the backside of ring 186 on clamping member 108 by virtue of the press fit between these parts. See FIG. 6. This will prevent the rearward flexing of the detent tabs 143 illustrated in phantom lines in FIG. 8 and thus effectively locks the adjusting member 170 in place on clamping member 108 in the solid line orientation of FIG. 8. Cover 180 needs to be removed by the user in order to rotate adjusting member 170. Thus, cover 180 has the same vandal resistant and locking functions provided by cover 80 of nozzle 2 although cover 180 uses somewhat different structure to accomplish the same results.

Applicants have found that nozzle 102 will adjust the throw radius without dramatically changing the precipitation rate thereof. This is true even though the angle of trajectory of nozzle channels 126 is not being simultaneously changed as was true of nozzle 2 in the first embodiment of this invention. Nozzle 2 does a somewhat better job in keeping precipitation rate constant, but nozzle 102 keeps any variation in precipitation rate to acceptable levels.

Nozzle 102 has the same basic advantages as nozzle 2, but is somewhat simpler and less expensive to manufacture. There are fewer total parts and a resilient or compressible upper nozzle piece is no longer required. Nonetheless, nozzle 102 is durable and easily adjustable to allow a single nozzle to throw to various radii for a given water pressure depending on the vertical position of deflecting ring 150.

Various modifications of this invention will be apparent to those skilled in the art. For example, channels 26 have been illustrated herein as having a square cross-sectional configuration, but different configurations could obviously be used. In addition, the lower face 155 of fingers 154 could have an angle of inclination different than that shown herein, with the caveat that such angle is preferably different than the angle of water dispersing surface 118 as noted above.

Figure 9:
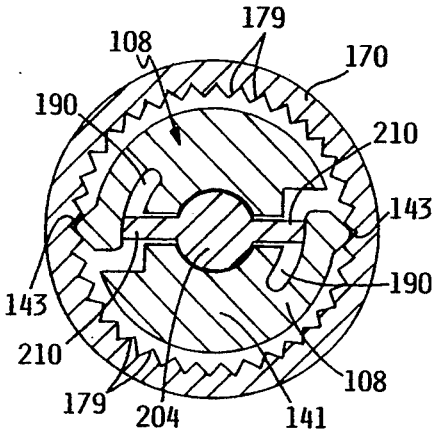
FIG. 9 is a cross-sectional view, taken along lines 9—9 in FIG. 10, of a third embodiment of a sprinkler nozzle according to the present invention.
Figure 11:
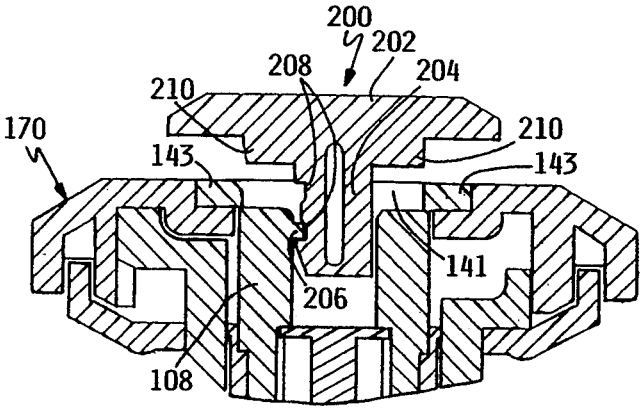
FIG. 11 is a partial cross-sectional side elevational view similar to that of FIG. 10, but showing the locking pin having been pulled up to its raised, open position in which a radius adjustment is permitted.
Figure 10:
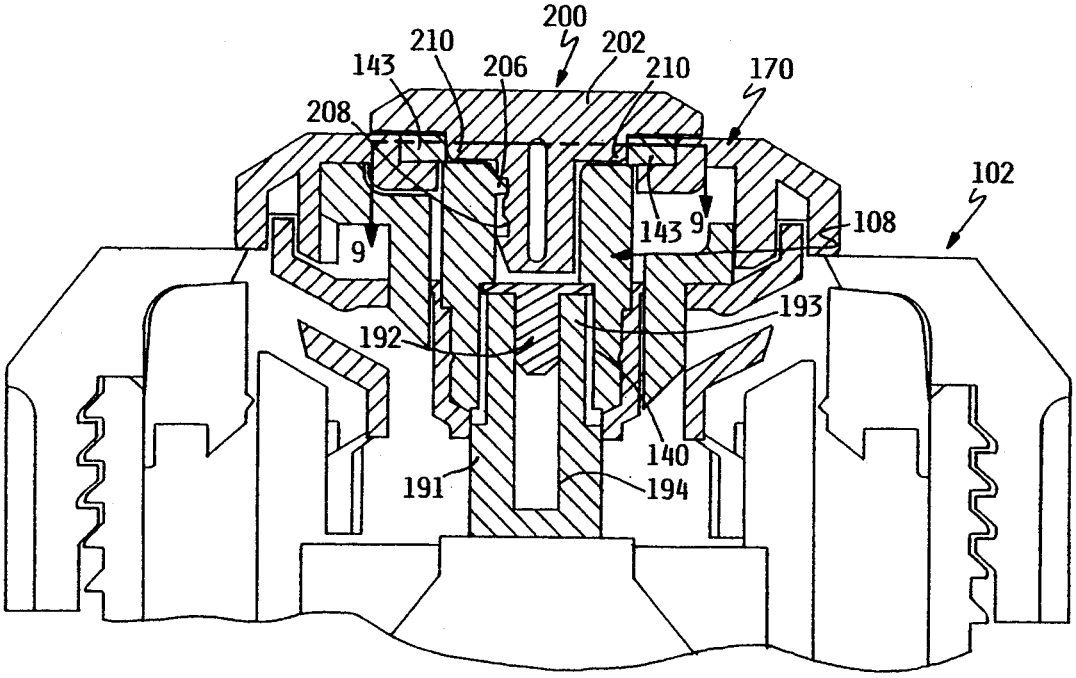
FIG. 10 s a partial cross-sectional side elevational view of a third embodiment of a sprinkler nozzle according to the present invention with the parts thereof shown in an assembled relationship, particularly illustrating a two-position locking pin for locking out the radius adjustment with the pin being shown in FIG. 10 in its lowered, closed position in which a radius adjustment is prevented.

A third embodiment of a sprinkler nozzle according to this invention is illustrated in FIGS. 9–11. This nozzle is essentially the same as nozzle 102 depicted in FIGS. 6–8, except that the means for locking out the radius adjustment is changed somewhat, the removable cover 180 in FIGS. 6–8 having been replaced in FIGS. 9–11 by a two-position locking pin 200 that remains on the sprinkler nozzle at all times. Accordingly, in describing the nozzle shown in FIGS. 9–11, the parts of this nozzle having counterparts in nozzle 102 will be described using the same reference numerals as used in describing nozzle 102 and its components—only the changed components, such as locking pin 200, will carry different reference numerals.

The locking means in nozzle 102 shown in FIGS. 9–11 is much the same as that in FIGS. 6–8. Rotatable adjusting member 170 still includes a set of inwardly extending radial serrations or splines 179. See FIG. 9. These splines 179 are engaged by two detent tabs 143 that extend radially outwardly from a flange 141 on a clamping member 108. Clearance slots 190 are still provided behind detent tabs 143 with tabs 143 being flexible to move from a radially outwardly biased position in engagement with splines 179 to an inwardly cammed position in which tabs 143 have been flexed back into clearance slots 190. In this regard, the solid and phantom line illustrations of the movement of tabs 143 as shown in FIG. 8 will apply equally to the tabs 143 shown in FIG. 9.

Because the two position locking pin 200 now occupies the space previously occupied by attachment screw 110, clamping member 108 is secured to the sprinkler body in a somewhat different fashion. Referring now to FIG. 10, the lower portion of the vertical passageway 140 of clamping member 108 now has an internally threaded inner diameter to allow the clamping member 108 to be screwed down onto the externally threaded upper end 193 of a gearbox output shaft 191 contained on the sprinkler body. The screw threads between clamping member 108 and the upper end 193 of gearbox output shaft 191 are not shown in FIG. 10 for the purpose of clarity. In any event, when clamping member 108 is firmly screwed down onto gearbox output shaft 191, clamping member 108 will hold the components of nozzle 102 together in an assembled relationship and will secure nozzle 102 to the sprinkler body.

Locking pin 200 is carried at the top of nozzle 102 to be accessible from above. Pin 200 is T-shaped having a generally, flat circular head 202 and a downwardly extending post or stem 204. The upper portion of the vertical passageway 104 in clamping member 108 includes a tab 206 that extends inwardly from an inner diameter thereof. That side of stem 204 which faces tab 206 contains two vertically spaced notches 208 that are suited to receive tab 206. The combination of tab 206 and notches 208 allows locking pin 200 to have two positions relative to nozzle 102, a raised, open position shown in FIG. 11 in which the radius adjustment means on nozzle 102 is unlocked to allow adjustment to take place and a lowered, closed position shown in FIG. 10 in which the radius adjustment means is locked out to prevent the radius of throw from being adjusted.

Locking pin 200 can be moved to its raised, open position by pulling up on the head 202 of pin 200 when pin is in the closed position of FIG. 10. In this regard, the underside of head 202 preferably has a cutout portion (not shown) around a small portion of the circumferential edge of head 202 to allow the user to better slip a fingernail or the blade of a screwdriver beneath head 202 to provide leverage to lift up on pin 200. Locking pin 200 can be returned to its lowered, closed position simply by pushing down on pin 200 when it is in its open position of FIG. 11. Tab 206 is sufficiently flexible, and the parts are so dimensioned, that tab 206 can disengage one notch 208 and can then reengage the other notch 208 during the vertical movement of pin 200 back and forth between its raised and lowered positions, the notches 208 simply forming the means for holding the pin 200 in either its raised or its lowered position. Pin 200 is non-rotatably received in the passageway 140 of clamping member 108 to allow the notches 208 to remain aligned with tab 206.

The purpose of locking pin 200 is, of course, to lock out the radius adjustment. In this regard, locking pin 200 has two locking flanges 210 that extend downwardly from the underside of head 202 and point radially outwardly towards the detent tabs 143. As shown in FIGS. 9 and 10, a single locking flange 210 is situated to abut against the backside of each one of the detent tabs 143 when the pin is in the lowered, closed position of FIG. 10. This prevents the detent tabs 143 from being flexed backward into the clearance slots 190, and thus effectively locks the adjustment member 170 in place, to prevent any adjustment in the throw radius. Thus, with pin 200 pushed down to its lowered, closed position, no radius adjustment can be done as adjustment member 170 is now non-rotatable relative to nozzle 102.

If a radius adjustment is desired, the user need only pull up on pin 200 to move pin 200 to its raised, open position shown in FIG. 11. In this position of pin 200, the locking flanges 210 have been raised above the level of detent tabs 143 such that detent tabs 143 are free to flex back into clearance slots 190. Thus, the user can now adjust the throw radius by reaching down and rotating adjustment member 170, the rotation of adjustment member 170 now being allowed as tabs 143 can flex back and be cammed away from splines 179 as rotation of adjustment member 170 takes place. When a desired amount of adjustment has taken place, the rotation of adjustment member 170 is ended and tabs 143 will flex back to their outwardly biased positions to reengage against the splines 179. If pin 200 is pushed back down to its lowered, closed position, such that locking flanges 210 again abut against the back of detent tabs 143, the radius adjustment is again locked out.

The use of two-position locking pin 200 to lock out the radius adjustment in the manner described above has some advantages. The primary one is that pin 200 is not prone to being lost and is always retained on nozzle 102. In the other embodiments of this invention, if covers 80 or 180 are misplaced or lost, or removed by vandals, then the lockout feature for the radius adjustment is inoperative until the cover is replaced.

As shown in FIGS. 9–11, pin 200 does not substantially overlie nozzle 102 and does not serve to hide nozzle 102 as was true of the covers 80 and 180 in the prior embodiments. However, if so desired, the head 202 of pin 200 could be extended to completely cover or shroud adjustment member 170 and pin 200 would then serve to cover or hide the top of sprinkler nozzle 102 in the same manner as in the prior embodiments, except that this cover would not be completely removable from nozzle 102 but would simply be movable between a lowered, closed position and a raised, open position on nozzle 102. Thus, pin 200 could be formed of a cover type member which would simultaneously serve to enclose and hide nozzle 102 as well.

Various modifications of this invention will be apparent to those skilled in the art. Thus, the scope of this invention is to be limited only by the appended claims.

We claim:

1. An adjustable radius sprinkler nozzle suited for connection to a sprinkler body, which comprises:

(a) a nozzle body having at least one nozzle passageway for spraying water therefrom, wherein the nozzle body includes a top surface and a peripheral sidewall portion, wherein the nozzle passageway(s) extend through the peripheral sidewall portion such that at least one radial stream of water is thrown out of the sidewall portion of the nozzle body beneath the top surface thereof;

(b) selectively operable radius adjustment means carried on the nozzle body for varying the amount of water flowing through the nozzle passageway(s) to adjust the radius of throw of the nozzle; and (c) selectively operable locking means carried on the nozzle body for preventing the operation of the radius adjustment means to prevent any change in the radius of throw when the locking means is engaged, wherein the locking means when engaged is located on the top surface of the nozzle body to be accessible by the user from above the nozzle body, and wherein the locking means comprises a cover that is removably engageable with the top surface of the nozzle body, the cover having means for preventing movement of the radius adjustment means when the cover is in place on the top surface of the nozzle body but which movement preventing means is disengaged from the radius adjustment means by separating the cover from the top surface of the nozzle body to completely remove the cover from the nozzle body.

2. A sprinkler nozzle as recited in claim 1, wherein the cover substantially overlies and covers the entire top surface of the nozzle body to hide the nozzle body.

3. A sprinkler nozzle as recited in claim 1, wherein the locking means comprises a movable locking member carried on the nozzle body and movable relative thereto between a first, closed position and a second, open position, the locking member having means for preventing movement of the radius adjustment means when the locking member is in its first, closed position but which movement preventing means is disengaged from the radius adjustment means when the locking member is in its second, open position, whereby the radius adjustment can be locked out by placing the locking member in its first, closed position and can be allowed by placing the locking member in its open, second position.

4. A sprinkler nozzle as recited in claim 1, wherein the nozzle body includes a plurality of circumferentially spaced nozzle passageways, and wherein the radius adjustment means is configured to simultaneously adjust the amount of water flowing through multiple ones of the nozzle passageways.

5. An adjustable radius sprinkler nozzle suited for connection to a sprinkler body, which comprises:

(a) a nozzle body having at least one nozzle passageway for spraying water therefrom;

(b) selectively operable radius adjustment means carried on the nozzle body for varying the amount of water flowing through the nozzle passageway(s) to adjust the radius of throw of the nozzle; and (c) selectively operable locking means carried on the nozzle body for preventing the operation of the radius adjustment means to prevent any change in the radius of throw when the locking means is engaged, wherein the locking means comprises a movable locking member carried on the nozzle body and movable relative thereto between a first, closed position and a second, open position, the locking member having means for preventing movement of the radius adjustment means when the locking member is in its first, closed position but which movement preventing means is disengaged from the radius adjustment means when the locking member is in its second, open position, whereby the radius adjustment can be locked out by placing the locking member in its first, closed position and can be allowed by placing the locking member in its second, open position, wherein the locking member comprises:

(i) an enlarged head suited to be received outside of an exterior surface of the nozzle body;

(ii) a stem secured to the head and received in an interior passageway in the nozzle body to allow the stem to slide in the passageway as the locking member moves back and forth between its first, closed position and second, open position; and (iii) cooperable detent means formed on the nozzle body and the locking member for holding the locking member in either its first or its second position.

6. A sprinkler nozzle as recited in claim 5, wherein the radius adjustment means includes a rotatable adjustment member mounted for rotation on the nozzle body.

7. A sprinkler nozzle as recited in claim 6, further including detent means for holding the adjustment member in a rotatively adjusted position on the nozzle body, the detent means comprising a set of serrations and at least one flexible detent tab engaging the serrations with the tabs being configured to flex away from the serrations during rotary movement of the adjustment member to allow the rotary movement of the adjustment member, and wherein the motion preventing means of the locking member abuts against the detent tabs to prevent any movement of the detent tabs to thereby keep the detent tabs in engagement with the serrations to prevent motion of the adjustment member.

8. A sprinkler nozzle as recited in claim 5, wherein the nozzle body includes a top surface, and wherein the locking member is vertically movable between its first and second positions with the head being located above the top surface of the nozzle body and the stem extending downwardly from the head into a vertical passageway in the nozzle body.

9. A sprinkler nozzle as recited in claim 5, wherein the nozzle body includes a plurality of circumferentially spaced nozzle passageways, and wherein the radius adjustment means is configured to simultaneously adjust the amount of water flowing through multiple ones of the nozzle passageways.

10. An adjustable radius sprinkler nozzle suited for connection to a sprinkler body, which comprises:

(a) a nozzle body having at least one nozzle passageway for spraying water therefrom;

(b) a selectively rotatable adjustment member carried on the nozzle body for varying the amount of water flowing through the nozzle passageway(s) to adjust the radius of throw of the nozzle;

(c) detent means for holding the adjustment member in a rotatively adjusted position on the nozzle body, the detent means comprising a set of serrations and at least one movable detent tab having a continuous ratchet engagement with the serrations with the tabs being configured to move sufficiently relativel to the serrations during rotary movement of the adjustment member to pass from one serration to the next as the adjustment member is turned and thereby to allow the rotary movement of the adjustment member; and (d) selectively operable locking means carried on the nozzle body for preventing rotation of the adjustment member to prevent any change in the radius of throw when the locking means is engaged, wherein the locking means includes motion preventing means which abuts against the detent tabs to prevent the movement of the detent tabs that is needed for the detent tabs to ratchet past the serrations to thereby keep the detent tabs locked in engagement with the serrations currently engaged by the detent tabs, thereby to prevent motion of the adjustment member.

11. A sprinkler nozzle as recited in claim 10, wherein the locking means comprises a cover that includes the motion preventing means and which is selectively engageable with the nozzle body to abut the motion preventing means against the detent tabs or is removable from the nozzle body to be completely separated therefrom to disengage the motion preventing means from the detent tabs.

12. A sprinkler nozzle as recited in claim 11, wherein the nozzle body comprises a peripheral sidewall portion with the nozzle passageway(s) extending through the peripheral sidewall portion, and wherein both the adjustment member and the locking cover are located above the nozzle passageways to be accessible from above the nozzle body.

13. A sprinkler nozzle as recited in claim 10, wherein the locking means includes a locking member comprising a push pin that is received in the nozzle body with the push pin having two positions on the nozzle body, the push pin carrying the motion preventing means which motion preventing means is engaged with the detent tabs in one position of the push pin and is disengaged from the detent tabs in the Other position of the push pin.

14. A sprinkler nozzle as recited in claim 13, wherein the push pin is vertically movable on the nozzle body with the one position being a lowered position on the nozzle body and the other position being a raised position on the nozzle body.

15. A sprinkler nozzle as recited in claim 14, wherein the nozzle body comprises a peripheral sidewall portion with the nozzle passageway(s) extending through the peripheral sidewall portion, and wherein both the adjustment member and the push pin are located above the nozzle passageways to be accessible from above the nozzle body.

16. A sprinkler nozzle as recited in claim 15, wherein the push pin includes an enlarged head which is placed above a top surface of the nozzle body.

17. An adjustable radius sprinkler nozzle suited for connection to a sprinkler body, which comprises:

(a) a nozzle body having a plurality of radially extending, circumferentially spaced nozzle channels through which water flowing from the sprinkler body must pass to thereby be formed into a plurality of separate radial streams, wherein the channels have outlet ends through which the streams exit from the nozzle;

(b) adjustable means carried on top of the nozzle body for varying the amount of water flowing through the channels to adjust the radius of throw of the nozzle, wherein the adjustable means includes movable means carried on the nozzle body for coacting with at least some of the radial nozzle channels to restrict the amount of water flowing therethrough; and (c) a removable cover overlying and covering the adjustable means, wherein the cover includes means for locking the coacting means against movement to prevent adjustment of the throw radius, wherein the locking means comprises a fixed abutment means carried on the cover which abutment means has a locking engagement that is effective to lock the coacting means against movement whenever the cover is in place overlying the adjustable means and which abutment means is released from its locking engagement whenever the cover is removed from its overlying relationship to the adjustable means, whereby the locking means is engaged simply by placing the cover in its overlying relationship to the adjustable means and is automatically released whenever the cover is removed from its overlying relationship to the adjustable means.

18. An adjustable radius sprinkler nozzle suited for connection to a sprinkler body, which comprises:

(a) a nozzle body having a plurality of radially extending, circumferentially spaced nozzle channels through which water flowing from the sprinkler body must pass to thereby be formed into a plurality of separate radial streams, wherein the channels have outlet ends through which the streams exit from the nozzle;

(b) adjustable means carried on top of the nozzle body for varying the amount of water flowing through the channels to adjust the radius of throw of the nozzle, wherein the adjustable means includes movable means carried on the nozzle body for coacting with at least some of the radial nozzle channels to restrict the amount of water flowing therethrough; and (c) a two-position locking pin carried on top of the nozzle body for vertical movement relative thereto, wherein the pin includes means for locking the coacting means against movement to prevent adjustment of the throw radius, wherein the locking means comprises fixed abutment means carried on the pin which abutment means has a locking engagement that is effective to lock the coacting means against movement whenever the pin is in a lowered position on the nozzle body and which abutment means is released from its locking engagement whenever the pin is in a raised position on the nozzle body, whereby the locking means is engaged simply by moving the pin into its lowered position and is released by moving the pin into its raised position.

* * * * *

UNITED STATES PATENT AND TRADEMARK OFFICE

CERTIFICATE OF CORRECTION

PATENT NO. 5,360,167

DATED November 1, 1994

INVENTOR(S) Michael J. Grundy et al.

It is certified that error appears in the above-indentified patent and that said Letters Patent is hereby corrected as shown below:

Title page, item [75],

In the identification of inventors, "Jeff B. McKenzie" should read --Jeff R. McKenzie--.

In claim 10, "relativel" should read --relative-- at Column 16, line 17.

In claim 13, "Other" should read --other-- at Column 16, line 57.

Signed and Sealed this

Twenty-eight Day of March, 1995

*Attest:*

*Attesting Officer*

BRUCE LEHMAN

*Commissioner of Patents and Trademarks*